United States Patent [19]

Power et al.

[11] Patent Number: 5,012,621

[45] Date of Patent: May 7, 1991

[54] LIFT SHAFT APPARATUS

[75] Inventors: Leslie Power; John Prewer, both of London, England

[73] Assignee: Inventio AG, Hergiswil, Switzerland

[21] Appl. No.: 439,359

[22] PCT Filed: Mar. 9, 1989

[86] PCT No.: PCT/EP89/00266

§ 371 Date: Oct. 2, 1989

§ 102(e) Date: Oct. 2, 1989

[87] PCT Pub. No.: WO89/08753

PCT Pub. Date: Sep. 21, 1989

[30] Foreign Application Priority Data

Mar. 15, 1988 [GB] United Kingdom ..... 8806063

[51] Int. Cl.[5] ..... E04B 1/34; E04B 1/348

[52] U.S. Cl. ..... 52/30; 52/79.1; 52/745; 52/122.1; 52/DIG. 12

[58] Field of Search ..... 52/30, 79.1, 745, 741, 52/DIG. 12, 79.9, 122.1

[56] References Cited

U.S. PATENT DOCUMENTS 3,110,907 11/1963 King .
4,095,380 6/1978 Dillon ..... 52/30
4,231,148 11/1980 Harding .

FOREIGN PATENT DOCUMENTS 2418310 9/1979 France .
90202 5/1972 German Democratic Rep. .
2015615 9/1979 United Kingdom .

*Primary Examiner*—John E. Murtagh
*Attorney, Agent, or Firm*—Sandler, Greenblum & Bernstein

[57] ABSTRACT

A lift shaft which includes a plurality of self-supporting, prefabricated shaft modules which can be stacked. The lift shaft is constructed from one or more generally "plain" modules; a module containing a fully assembled lift car, optionally containing a counterweight which is temporarily supported for transit to the erection on-site; a fully assembled upper lift motor room module, including winding apparatus and electronic equipment for the lift; and a pit module which is to be suspended from a module above. The lift shaft and modules are designed so that they can be used as containers for fully assembled lift cars and/or counterweights between the factory and the building site so that a lift shaft module can be craned into position with a complete car and/or counterweight.

15 Claims, 5 Drawing Sheets

LIFT SHAFT APPARATUS

BACKGROUND OF THE INVENTION

1. Field of the Invention

The invention provides a lift shaft comprising a stack of separate self-supporting prefabricated shaft modules, each module having a structural strength sufficient to support the module or modules above, whereby the shaft can be supported from a lower module; an uppermost module containing winding apparatus for a lift car and a counterweight to raise and lower the car and a counterweight in the shaft; and each module having door means operable in conjunction with the lift car to provide access to and from the car when the car is disposed in the respective module.

2. Description of Background and Relevant Information

The lift shaft system defined above provides a much faster way of installing and commissioning lifts involving prefabricating lift shaft modules including lift motor rooms for erection on site.

The lift shafts are made, preferably, of sheet steel sections which are joined together to form tubes with open tops and bottoms.

These tubes are typically sized to meet individual building floor to floor height dimensions and the number of lifts required in each shaft. The only restrictions imposed on the sizing of the shafts is determined by transportation or crane capacity limitations.

A lift shaft construction of this kind is known from the DD-PS 90 202. The shaft modules are made of sheet steel or plastics. The lowermost module is bolted on a base plate. The upper and lower peripheries of the modules have flange fittings with guide brackets. Once stacked, the modules are bolted or bonded. The uppermost module contains the equipment to raise and lower the lift car in the shaft. The main disadavantage of the known lift shaft construction lies in the extensive requirement for skilled on-site labor for lift installation work. Another disadvantage is that for the inherent equipment of the modules, there is neither a weather proof nor a dirt-proof protection during transport and on site installation work.

SUMMARY OF THE INVENTION

The invention has the purpose of the creation of lift shaft modules enabling an economical and simple erection of lift shafts.

The advantage attained by the invention is to be seen substantially in that the lift shaft modules with all the equipment can be fitted under factory conditions away from the building site.

The lift shaft modules are designed so that they can be used as containers for fully assembled lift cars and/or counterweights between the factory and the building site so that a lift shaft module can be craned into position with complete car and/or counterweight. One of the modules is prefabricated with the lift car and/or counterweight installed and temporarily supported in the module for transport to a direction on site, the arrangement being such that once the module has been erected, the car and the counterweight are coupled to the winding means in the uppermost module and the temporary support for the car and the counterweight in the module is then released to enable the car and the counterweight to be raised and lowered in the shaft.

Each storey-height lift shaft module leaves the factory as a sealed weatherproof container-like unit. The top and bottom openings of each lift shaft module are sealed with translucent glass fibre-reinforced plastic (G.R.P.) covers. The bottom cover is removed on-site shortly before each module is craned into position. The top cover remains until shortly before the next module is due to be placed in position.

The ribs of the channel sections of the lift shafts are spaced and sized to facilitate the attachment on-site of plasterboard sheets which provide the requisite fire resistance for the lift shafts. The design of the channel sections is such that they can be used as permanent shuttering for in-situ concrete lift shafts if required (as described in U.K. Patent No. 2015615).

The design of the joints between each lift shaft section is such that they can be plumbed and levelled quickly and accurately. Tolerances achieved are far lower than those normally possible for traditionally constructed lift shafts.

The design of the joints is such that they provide seals against penetration of fire and smoke using a fire stop compound applied from both above and below the joint. The underside of the junction between the pressed metal formwork and the upper face of the lower steel angle is sealed using a gunned firestop mastic compound and then a liquid fire stop compound is applied to the top side of the pressed metal formwork. A resilient foam plastic strip (which also seals the joint between the lift shaft and the G.R.P. covers) prevents rainwater or fire stop compound in its liquid state from entering the lift shaft during the erection phase.

BRIEF DESCRIPTION OF THE DRAWINGS

The following is a description of same specific embodiments of the invention reference being made to the accompanying drawing in which.

DETAILED DESCRIPTION OF THE PREFERRED EMBODIMENTS

Figure 1:
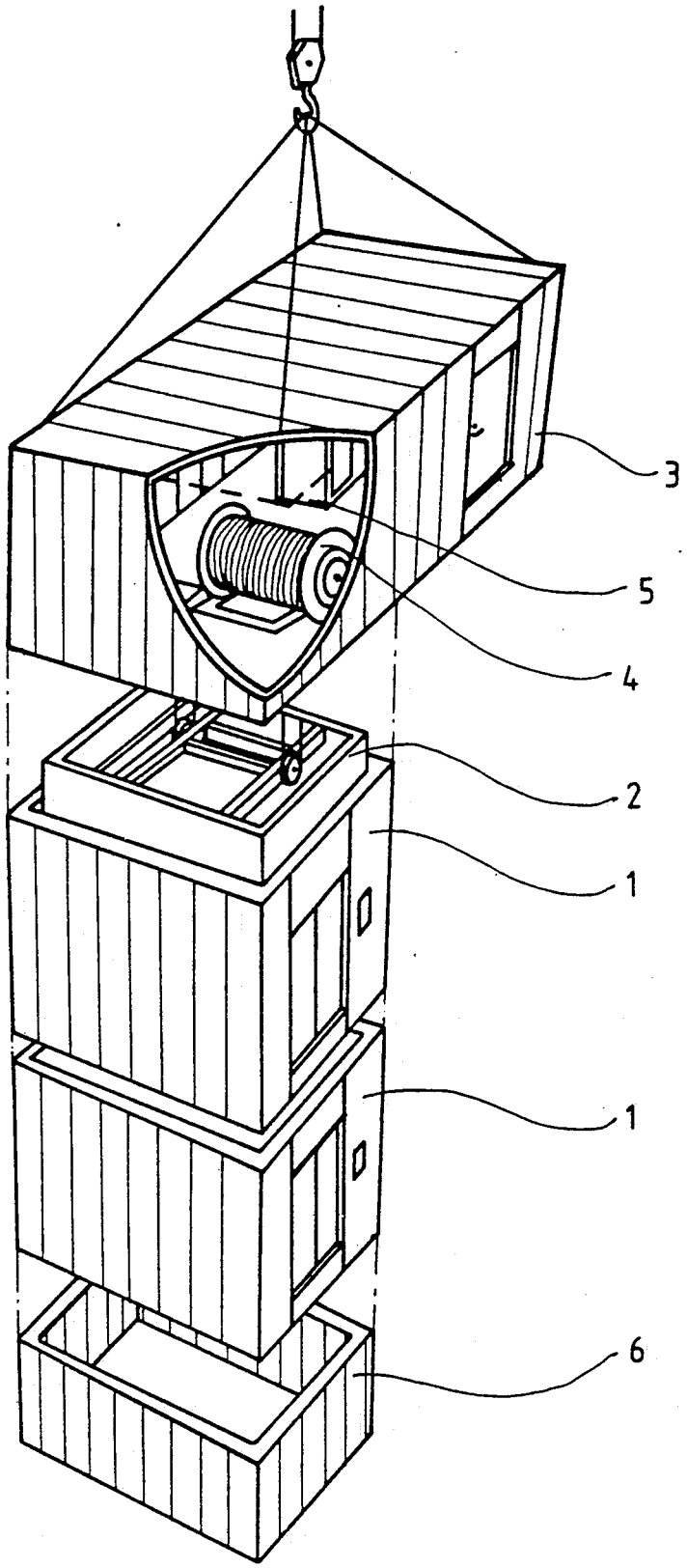
FIG. 1 a perspective view of a lift shaft according to the invention comprising prefabricated shaft modules.
Figure 2:
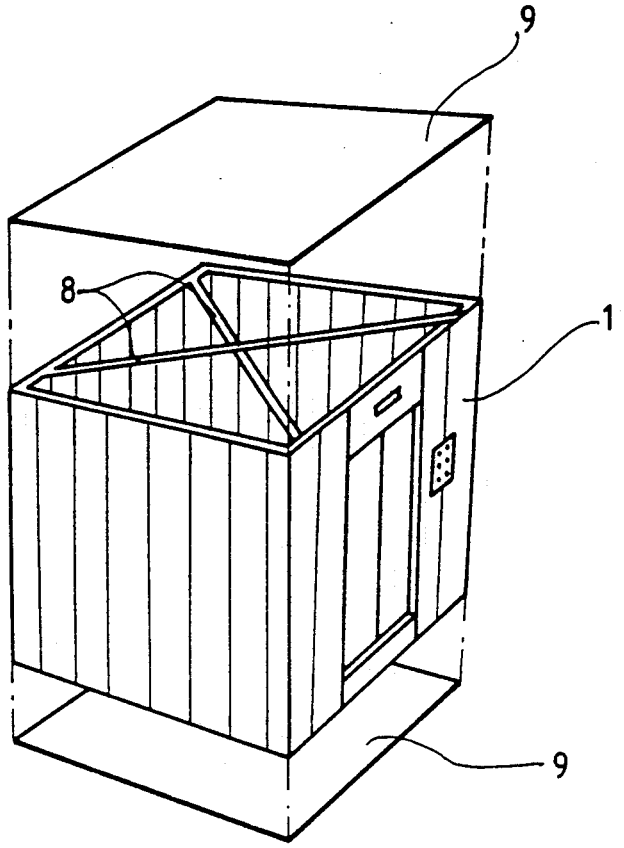
FIG. 2 is a perspective view of one of the modules showing temporary cross-bracing and covers for transport.
Figure 3:
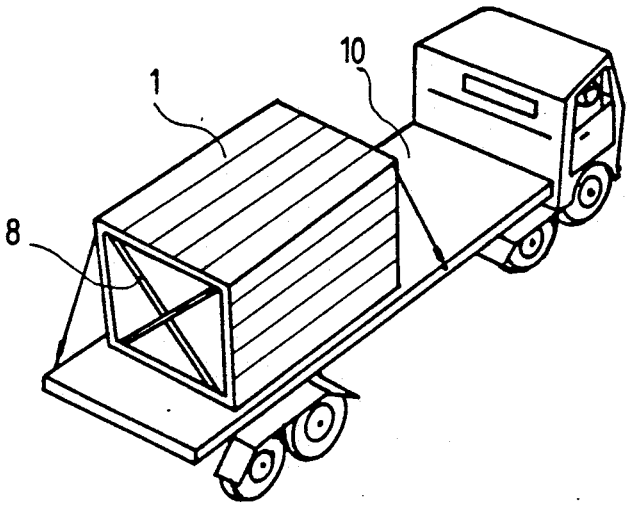
FIG. 3 illustrates the module of FIG. 2 in transport.

In FIGS. 1 to 11 the lift shaft comprises prefabricated fully assembled shaft modules 1 including one or more plain modules, a module in which a fully assembled lift car 2 and/or a, not shown, counterweight are temporarily supported for transit to the site and erection on-site, a fully assembled upper lift motor room module 3 including winding apparatus 4 and electronic equipment 5 for the lift, and a pit module 6 suspended from the module 1 above to lie in a preformed pit 7 in the lowermost part of the building. A temporary cross-bracing fixed to the top and the bottom for transit of the modules 1, 3, 6 is designated by 8 and a weatherproof temporary transluscent G.R.P. cover bolted to the top and the bottom for transport of the modules 1, 3, 6 is designated by 9. In transport, the door opening of a module is located lowermost on a transport vehicle 10.

Figure 4:
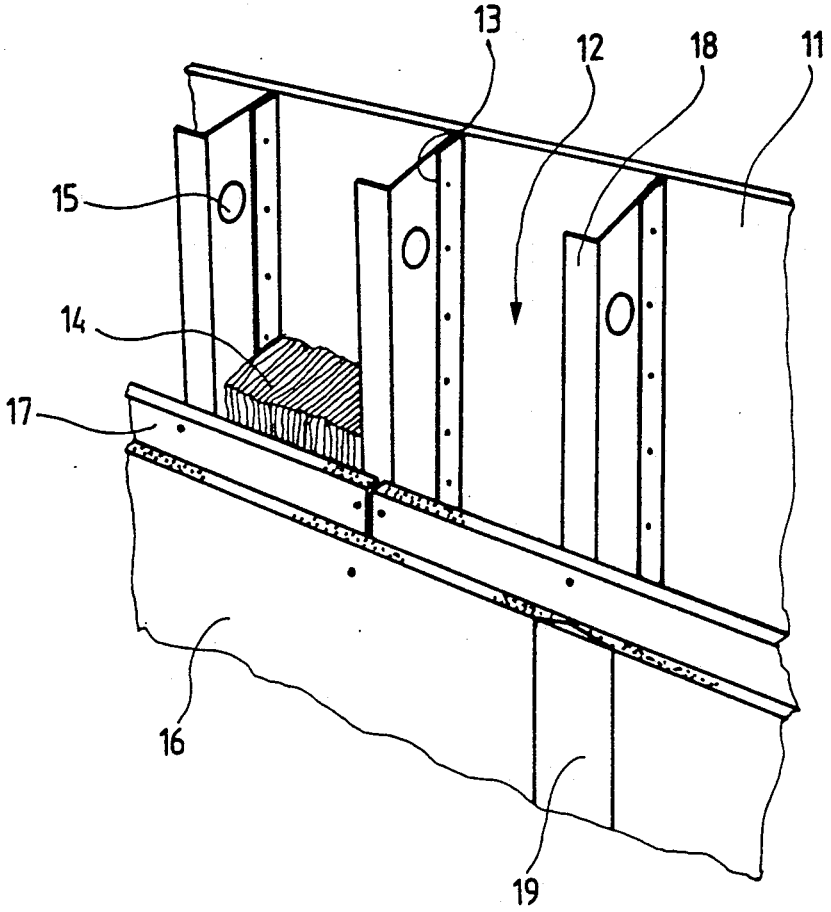
FIG. 4 is a perspective view of part of a wall construction for each lift module.

An external facing of the lift shaft is shown in FIG. 4.

Figure 5:
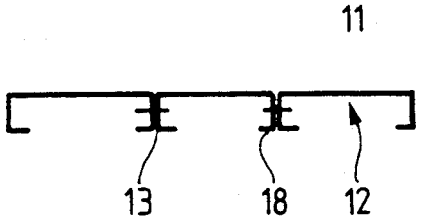
FIG. 5 illustrates an alternative section panel for the walls.
Figure 8:
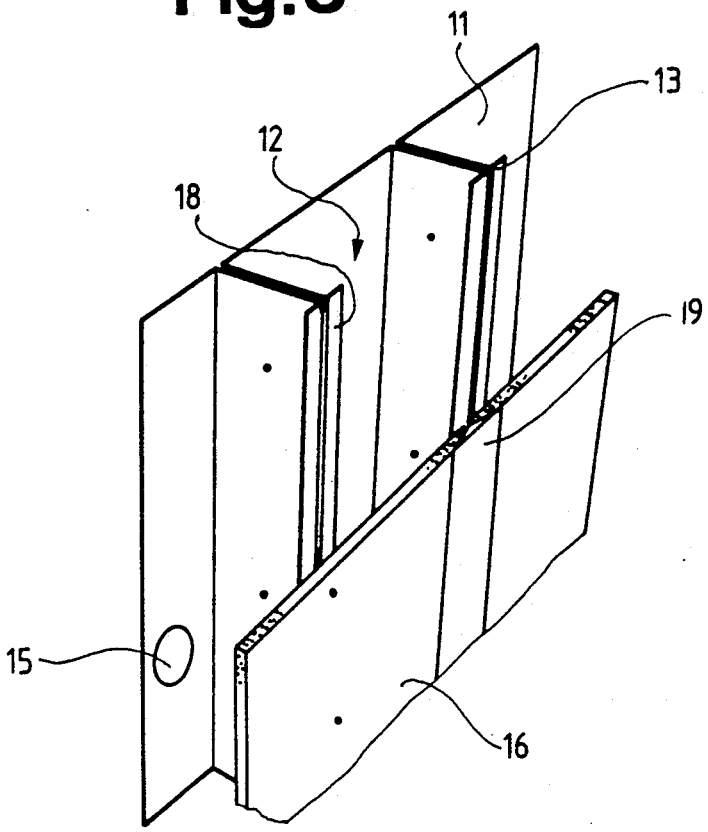
FIGS. 8 to 10 illustrate further constructional features.

FIGS. 5 and 8 depict a plan of alternative wall panel profiles. The modules 1, 3, 6 have walls formed from vertically extending channel section members of galvanized steel sheets 11. They are rivetted or press jointed together side-by-side with the channels facing outwardly of the shaft whereby the bases of channels 12 form a continuous internal surface around the shaft. The joint 13 of the steel sheets is sealed by a mastic. In the channels 12 mineral wool 14 bonded to steel is provided to reduce sound transmission and drumming. Prepunched openings for services are designated by 15. Two thicknesses of plasterboard 16, 17 with lapped joints are screwed to the steel ribs 18 of the module. Each of the joints of the outer plasterboards 16 are closed by a taperedged plasterboard 19.

Figure 6:
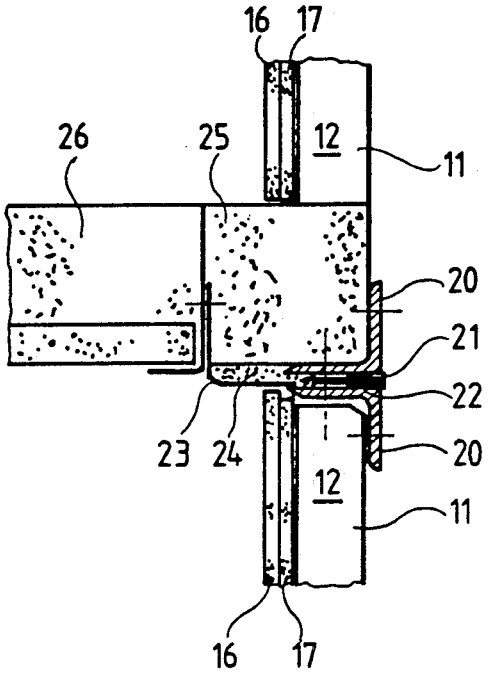
FIG. 6 illustrates a joint between adjacent upper and lower modules.
Figure 7:
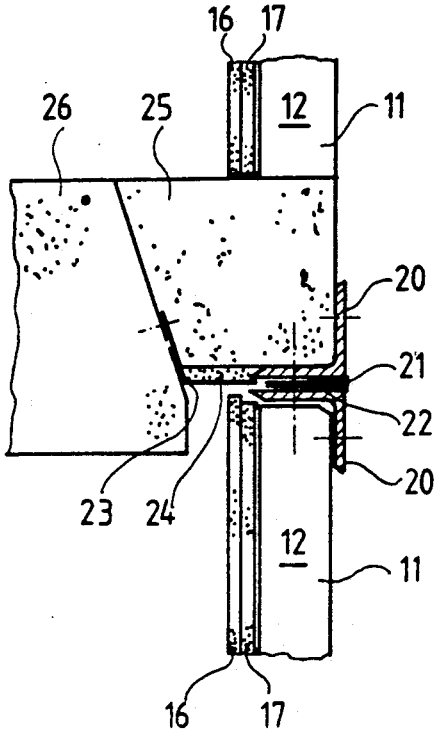
FIG. 7 illustrates an alternative floor construction adjacent the joint between the modules.

Details of a joint between adjacent upper and lower modules are shown in FIGS. 6 and 7. The upper and lower peripheries of the modules 1, 3, 6 have encircling flanges 20 and the modules are stacked with spacer means in the form of shim plates 21 between the adjacent flanges 20. Compressible weather sealing strips 22 are located between the shim plates 21. Bolts and locating pins permit fast and acurate plumbing of the modules when installing them on-site. On the inner side of the joint a preformed metal formwork 23 is provided and filled with a fire stop compound 24 and dryish concrete 25 to ensure a fire and smoke resistant joint between lift modules. At the level of the fire and smoke resistant joint a concrete floor 26 is formed.

Figure 9:
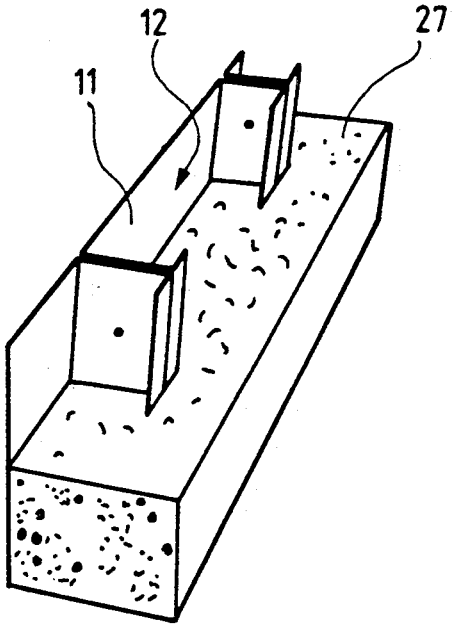
Figure 10:
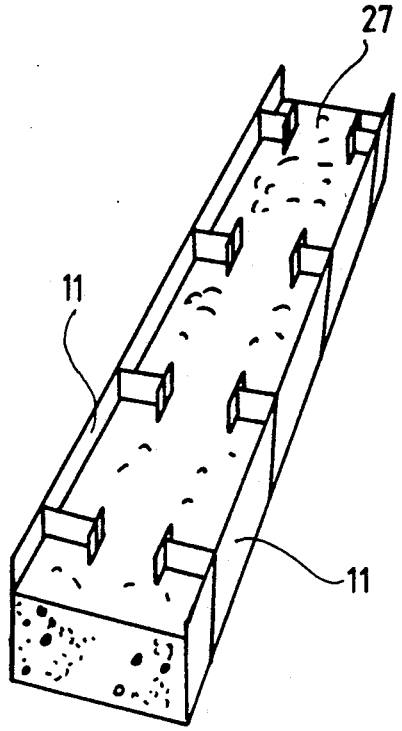

FIGS. 9 and 10 depict lift shafts wall construction options. The module walls are used as permanent shuttering and reinforcement for in-situ concrete lift shafts whereby the shaft wall consists of steel sheets 11 and a fill of in-situ concrete 27.

Figure 11:
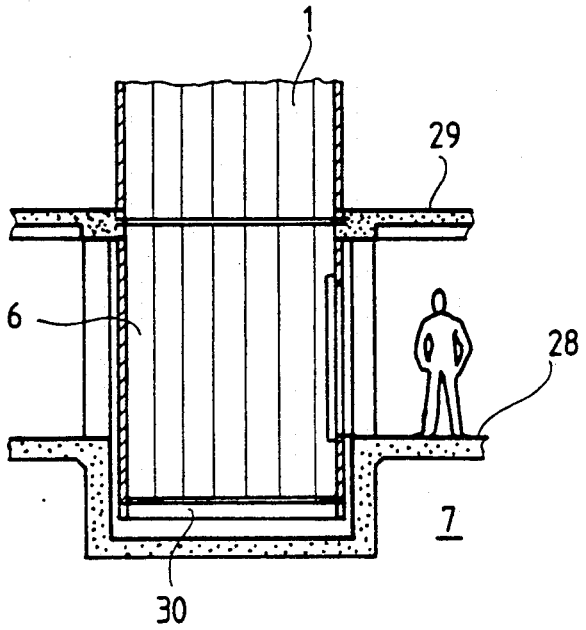
FIG. 11 illustrates the arrangements of the lowermost module.

FIG. 11 shows a vertical section through the lowermost or pit module 6 extending into the pit 7 in the basement 28 of the building and being suspended from the module 1 of the first floor 29. The first floor module 1 is adapted to be supported in the structure of the building to support the modules 1, 3 of the shaft above. If necessary, the lift pit can be incorporated into the pit module 6. If so, an integral floor 30 is provided in the lowermost module 6. The structural loads of the pit module 6 are carried to the module above and transferred to the adjacent floor structure.

We claim:

1. An apparatus for assembling a lift shaft comprising:

a plurality of separate self-supporting prefabricated lift shaft modules adapted to be stacked to form a lift shaft at a building site;

said plurality of modules being adapted to be used as containers for carrying a fully assembled lift car and counterweight between a factory and said building site;

each of said plurality of modules having a structural strength sufficient to support at least one of said plurality of modules above, said lift shaft formed by said stacked modules being adapted to be supported by a module below an uppermost module of said stacked modules;

said plurality of modules further comprising a module adapted to be an uppermost module, containing winding apparatus for connection to said lift car and to said counterweight for raising and lowering said lift car and said counterweight in said lift shaft;

each of said plurality of modules comprising a door adapted for operation in conjunction with said lift car for providing access to and from said lift car at each respective module; and each of said plurality of modules further comprising an upper end and a lower end; a respective encircling flange and sealing strip surrounding each of said upper end and said lower end; and a respective temporary cover to form container-like units.

2. An apparatus according to claim 1, said plurality of modules further comprising a module adapted to be a lowermost module.

3. An apparatus according to claim 2, said module adapted to be a lowermost module having an integral floor.

4. An apparatus according to claim 1, said upper end and said lower end of respective ones of a plurality of said plurality of modules being open.

5. An apparatus according to claim 4, further comprising temporary cross-bracing fixed to said open upper ends and said open lower ends.

6. A lift shaft comprising:

a stack of separate self-supporting prefabricated lift shaft modules;

said plurality of modules being adapted to be used as containers for carrying a fully assembled lift car and counterweight between a factory and said building site;

each of said plurality of modules having a structural strength sufficient to support at least one of said plurality of modules above, said lift shaft being adapted to be supported by a module below an uppermost module of said stacked modules;

said plurality of modules further comprising an uppermost module, containing winding apparatus for connection to said lift car and to said counterweight for raising and lowering said lift car and said counterweight in said lift shaft;

each of said plurality of modules comprising a door adapted for operation in conjunction with said lift car for providing access to and from said lift car at each respective module;

each of said plurality of modules further comprising an upper end and a lower end;

a respective encircling flange surrounding each of said upper end and said lower end;

sealing strips positioned between adjacent lift shaft modules of said stack; and spacers positioned between adjacent lift shaft modules of said stack.

7. A lift shaft according to claim 6, comprising a preformed metal formwork between adjacent lift shaft modules, said preformed metal formwork being filled with a fire stop compound and dryish concrete for sealing joints between said adjacent lift shaft modules against penetration of fire and smoke.

8. A lift shaft according to claim 6, each of said plurality of modules having walls formed from vertically extending channel section members secured together side-by-side having channels facing outwardly of the shaft, wherein said channel section members have bases which form a continuous internal surface around the shaft.

9. A lift shaft according to claim 8, further comprising insitu poured concrete adjacent said channel section members.

10. A lift shaft according to claim 8, further comprising sound insulation adjacent said walls.

11. A lift shaft according to claim 8, said channel section members having ribs, said lift shaft further comprising plasterboard panels affixed adjacent said ribs.

12. A lift shaft according to claim 6, further comprising a concrete floor proximate a lower portion of each of said modules.

13. A lift shaft according to claim 6, said plurality of modules further comprising a lowermost module which is adapted to be supported within a building for supporting the remainder of said plurality of modules, said lowermost module being suspended from an adjacent module and extending into a lift pit in said building.

14. A lift shaft according to claim 13, said lowermost module having a prefabricated integral floor.

15. A lift shaft according to claim 6, each of said plurality of modules having a peripheral wall formed from (i) a plurality of inner vertically extending channel section members secured together side-by-side having outwardly facing channels; (ii) a plurality of outer vertically extending channel section members secured together side-by-side having inwardly facing channel members; and (iii) insitu poured concrete between said plurality of inner vertically extending channel section members and said plurality of outer vertically extending channel section members.

* * * * *